US010349710B1

(12) United States Patent
Talesara

(10) Patent No.: US 10,349,710 B1
(45) Date of Patent: Jul. 16, 2019

(54) DIAMOND JEWELRY DEVICE

(71) Applicant: Goldstar Jewellery LLC, New York, NY (US)

(72) Inventor: Akash Talesara, Mumbai (IN)

(73) Assignee: Gold Star Jewellery PVT LTd, Mumbai (IN)

( * ) Notice: Subject to any disclaimer, the term of this patent is extended or adjusted under 35 U.S.C. 154(b) by 0 days.

(21) Appl. No.: 15/968,497

(22) Filed: Jul. 2, 2018

Related U.S. Application Data

(60) Provisional application No. 62/710,193, filed on Feb. 12, 2018.

(51) Int. Cl.
*A44C 17/02* (2006.01)
*A44C 25/00* (2006.01)
*A44C 15/00* (2006.01)

(52) U.S. Cl.
CPC ..... *A44C 17/02* (2013.01); *A44C 15/005* (2013.01); *A44C 25/001* (2013.01)

(58) Field of Classification Search
CPC ..... A44C 17/02; A44C 17/00; A44C 25/001
USPC ..... 63/28
See application file for complete search history.

(56) References Cited

U.S. PATENT DOCUMENTS 7,707,722 B1 * 5/2010 Kothari ..... A44C 17/04 29/10

* cited by examiner

*Primary Examiner* — Abigail E Troy
(74) *Attorney, Agent, or Firm* — Inventa Capital PLC

(57) ABSTRACT

A jewelry device of the present invention a close-back plate, a base plate, a faceted plate, a bail, and a chain. The back plate is designed to be light weight and encloses the dorsal side of the jewelry. The components are manufactured by lost wax investment casting technique. The base plate is provided with seat and prongs to hold the diamond on the top and consists of negative space to affix and position the faceted plate for easy assembly. The diamonds at the top are center of decoration.

13 Claims, 4 Drawing Sheets

DIAMOND JEWELRY DEVICE

RELATED APPLICATIONS

This non-provisional patent application claims priority to a provisional patent application Ser. No. 62/710,193 filed on Feb. 12, 2018 and incorporated herewith by reference in its entirety.

FIELD OF THE INVENTION

The current invention relates to the design of diamond set chain-jewelry ornaments, and more particularly to diamond setting technique and scintillating diamond faceted design.

BACKGROUND OF THE INVENTION

Tapper baguettes cutting diamonds were developed to accommodate elongated, rough diamonds whose ends are uneven. One end is wide and the other end is narrower, its appearance is sharpened and pointed like a stake. Unlike other elongated diamonds, the baguette diamonds, which are rectangular in shape, are partially cut by sawing elongated crystals. It saves the stone from flaws and truncates the impurities. Although, there are less facets to deal with then with round stones, the tappers are more susceptible to breakage.

Thus, making the setting of tappers onto the metal difficult, and thus has to be wax set. Procurement of these stones is challenged by varied size range, making it less production friendly for jewelry manufacturing. Moreover, for wax setting the diamond there is least tolerance in sizes of the diamonds and the tapper angle being different makes it more difficult for mass production. The wax set casting reduces the shine and fire of the tapper diamonds, the inventions overcomes the limitations of the traditional process.

The jewelry is composed of tappers base, close-back, faceted plate and bail. The key element of an ornament is that it has diamonds or gems embedded on it. The bail is provided with prongs and seat to occupy the diamonds and add aesthetic value. The chain is passed through the bail as the jewelry is hinged along the chain and bail.

There is a need for a new method and device for a unique jewelry by combination of handcrafted casting jewelry and machine faceted plate.

SUMMARY OF THE INVENTION

A jewelry device includes a close-back plate, a base plate, a faceted plate, a bail connected to the base plate. The back plate is designed to be light weight and encloses the dorsal side of the jewelry device. The back plate includes an inner circle and an outer circle. A plurality of radial connectors extends from the inner circle to the outer circle to form a plurality of windows between the inner circle and the outer circle.

A plurality of radial elements extends from the outer circle. The back plate is flat is cross section. The faceted plate has a generally circular configuration and presents a plurality of wedged elements. The wedged elements are interconnected by neck portions extending from side walls of each of the wedge element. Each wedge element includes a generally conical shape and present an outer edge and an inner edge. The outer edge and the inner edge include several gates. The gates are used to hold diamonds. The faceted plate has a generally flat cross section. The base plate includes a peripheral wall presenting an upper rim and a lower rim spaced from the upper rim and separated by supports.

A plurality of tower members of a generally square configuration extends from the upper rim. Each tower member presents an opening to hold the diamond therein. The upper rim further includes a first row of fingers or prongs extending there from and a second row of fingers or prongs also extending from the upper rim. The base plate is provided with the seats and the prongs to hold the diamonds on the top and further includes negative space to affix and position the faceted plate for easy assembly. The diamonds at the top are center of decoration.

The base plate also possesses split prongs for setting round diamond peripheral to the taper prong region. The prong emerges making a channel for the facet plate and at the center where the diamonds can be placed. A hoop structure is provided on the top base to entrench the bail thereafter. The upper rim also includes a central wall of a circular configuration defining a plurality of central fingers located around openings.

The upper rim presents a bottom surface that defined a seat formed between the first row of the fingers and the second row of the fingers. The seat is used to engage and secure the faceted plate. The bottom surface of the upper rim also presents a step to engage and secure the back plate. The components of the device, i.e. the close-back plate, the base plate, the faceted plate, and the bail are manufactured by lost wax investment casting technique.

The faceted plate is manufactured by lost wax investment casting method which matches with the negatives and voids for the protruded prong of the base plate. The faceted plate undergoes metal cutting operation in a fan rotary machine with diamond tools. The faceted plate is then placed into the base plate of the jewelry device, such that the faceted plate submerges inside the base plate and the prongs protrude from within.

The tapper baguette diamonds are manually set in a particular pattern. The wide ends are at the outer end from the center-keeping the taper ends towards the center.

There is an alternate arrangement of the tapper diamonds, making the below plate visible between the two tappers. The assembly is designed such that, the faceted plate below the tapper along with the real tapper diamond creates an illusion.

As a result of the illusion, the setting can be depicted as the jewelry is entirely studded with tapper diamond. The bail can also be provided with prongs and counters for setting diamonds. The bail is attached inside the hoop at the top of the base plate and soldered. The close back, base-plate and the bail are soldered to complete the assembly.

Advantages and meritorious features of this invention will be more fully understood from the following description of the preferred embodiment, the appended claims, and the drawings; a brief description of which follows.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
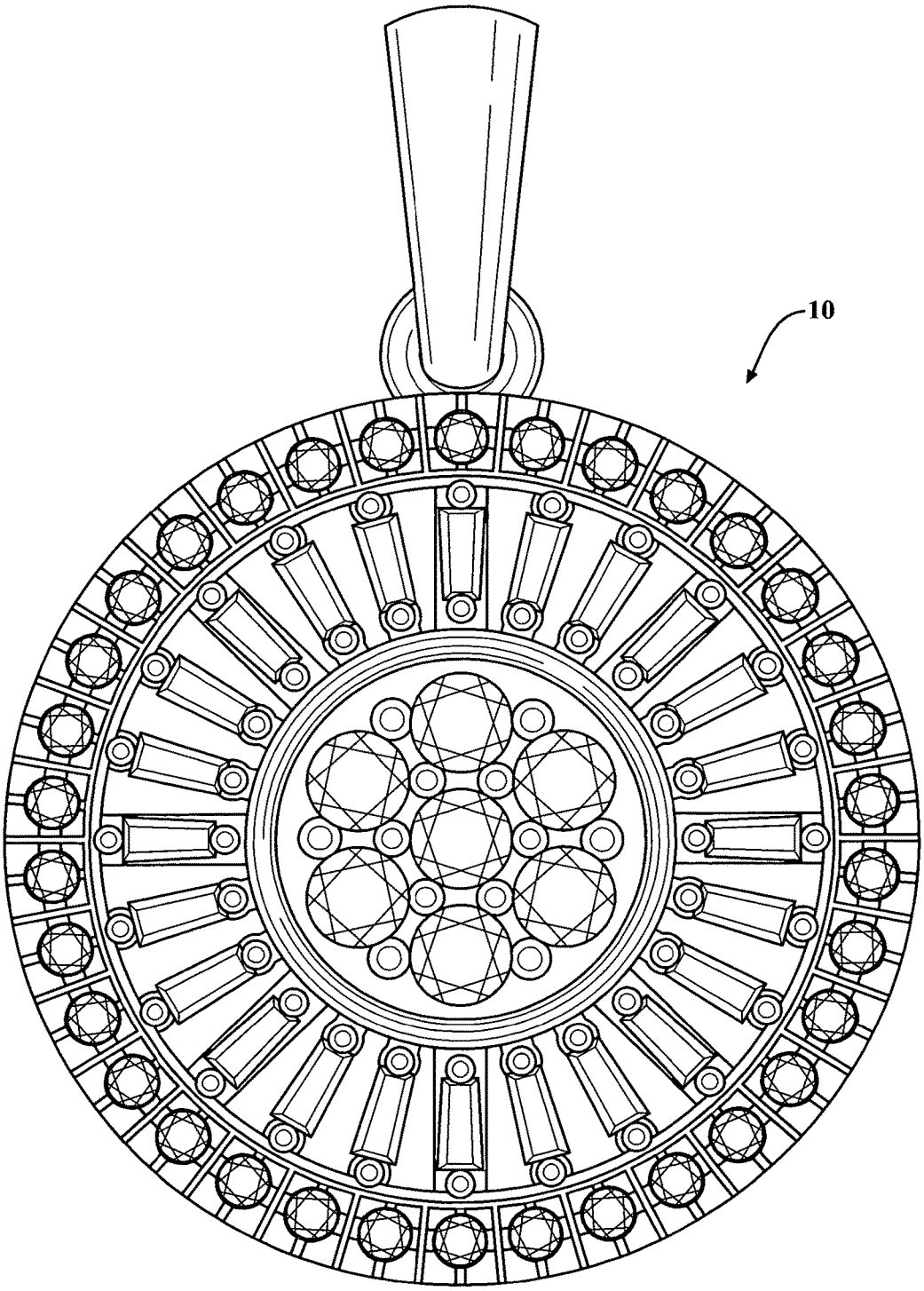
FIG. 1 illustrates a top view of a jewelry device of the present invention.

Referring to the FIGS. 1 through 4, wherein numbers indicate like or corresponding parts, a jewelry device of the present invention is generally shown at 10. The device 10 includes a close-back plate, generally indicated at 12, a base plate, generally indicated at 14, a faceted plate, generally indicated at 16, and a bail 18 connected to the base plate 14. The bail 18 is used to receive a chain (not shown). The back plate 12 is designed to be light weight and encloses the dorsal side of the jewelry device 10.

Figure 2:
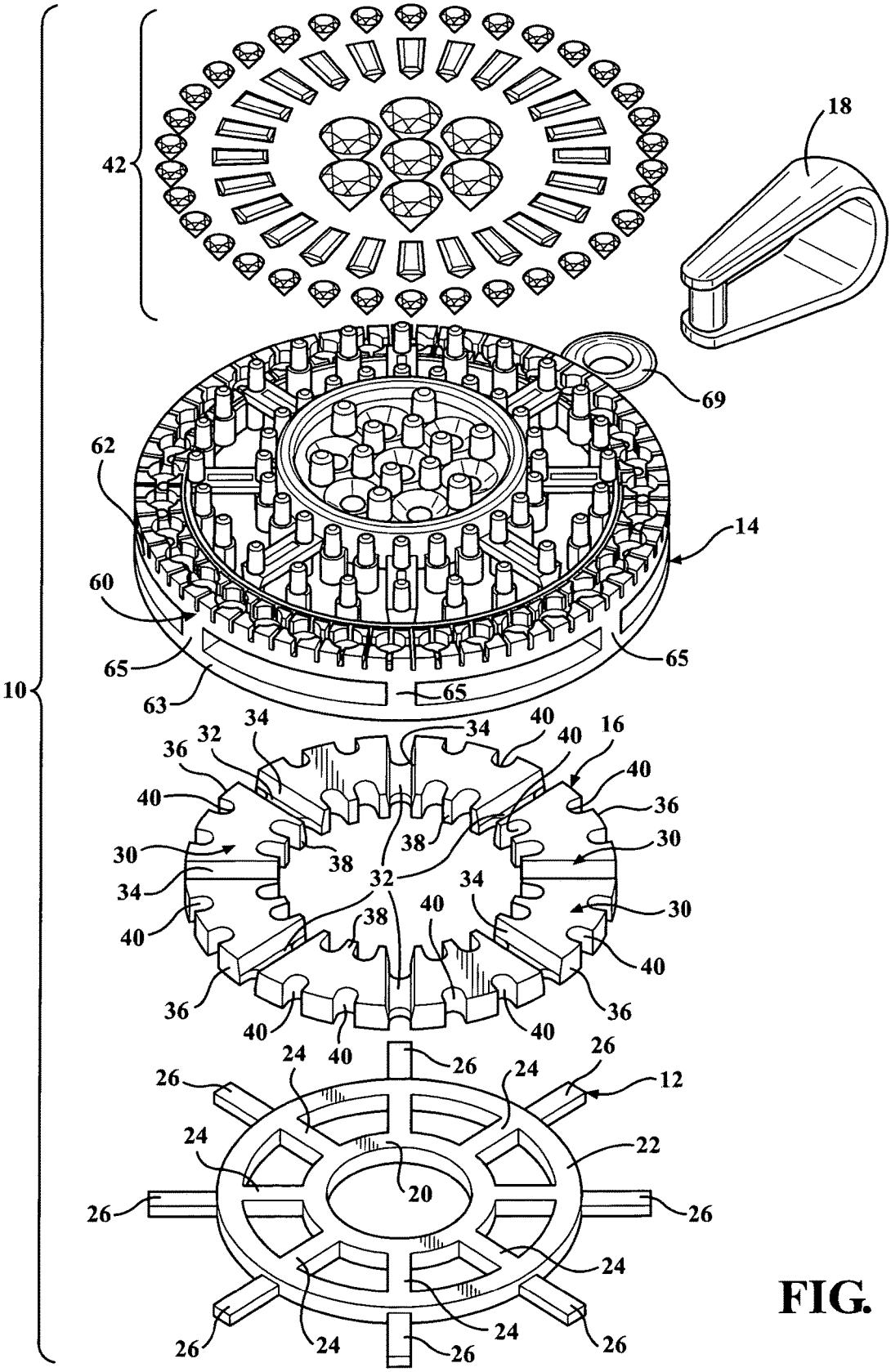
FIG. 2 illustrates an exploded view of the jewelry device of FIG. 1.
Figure 3:
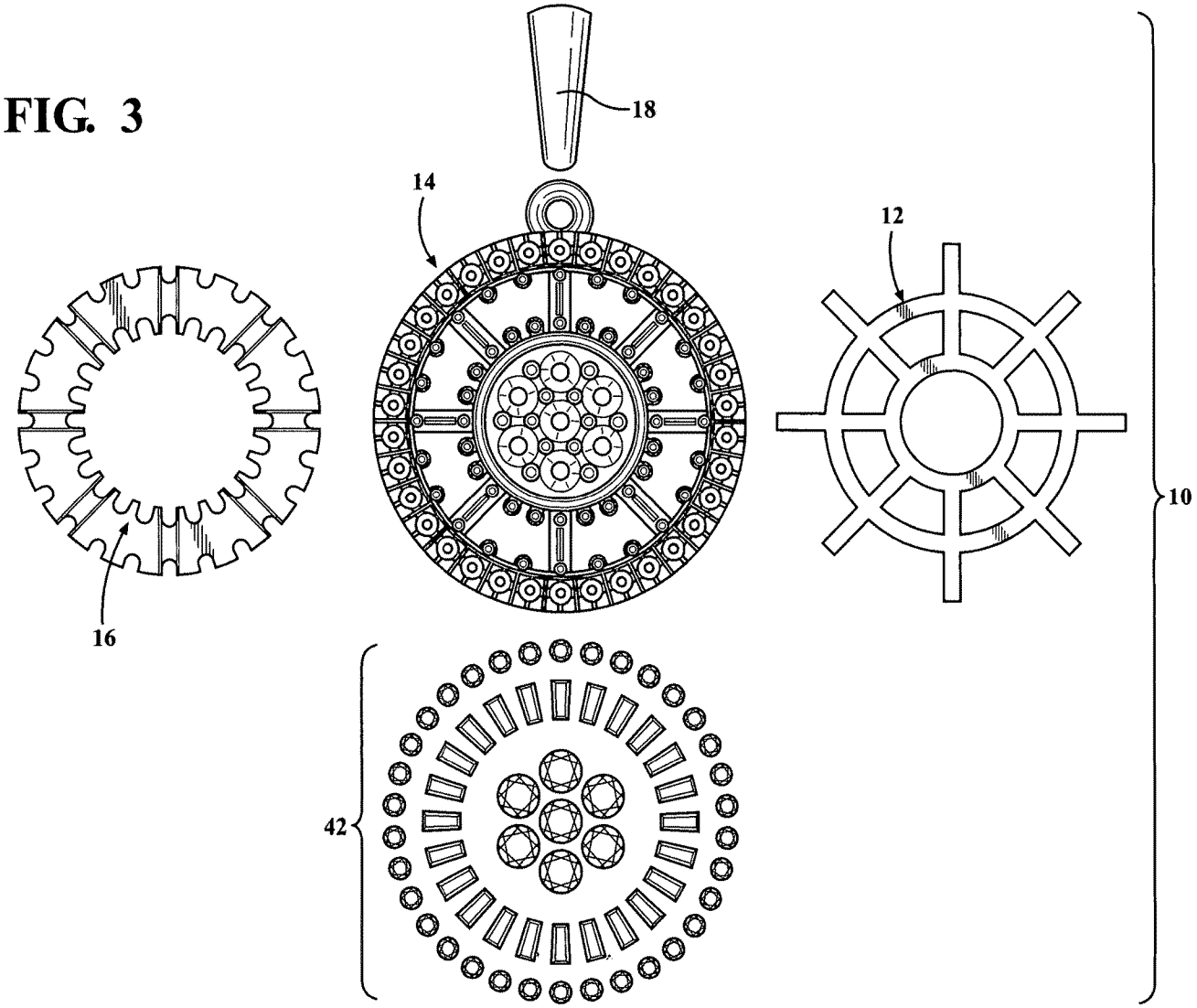
FIG. 3 illustrates a disassembled view of the jewelry device of FIG. 1.
Figure 4:
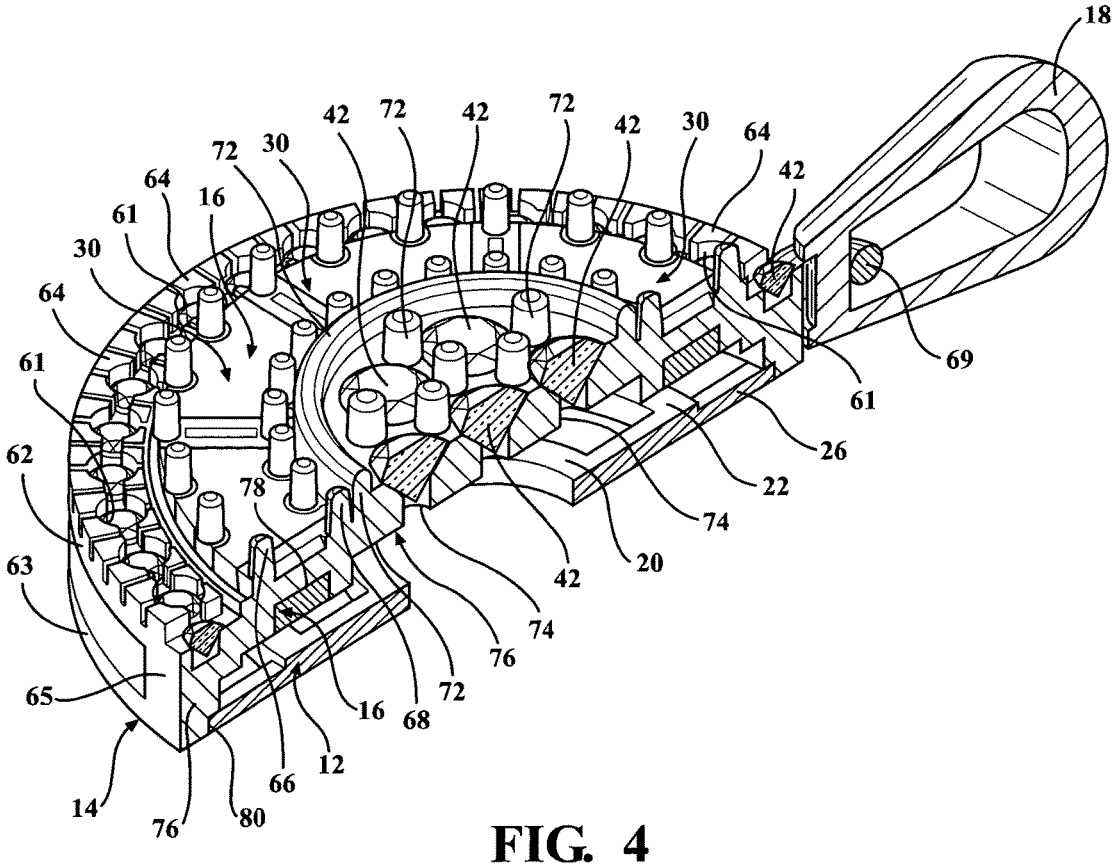
FIG. 4 illustrates a perspective and cross-sectional view of the jewelry device of FIG. 1.

Referring to FIGS. 2 and 4, the back plate 12 includes an inner circle 20 and an outer circle 22. A plurality of radial connectors 24 extend from the inner circle 20 to the outer circle 22 to form a plurality of windows between the inner circle 20 and the outer circle 22. A plurality of radial elements 26 extend from the outer circle 22. The back plate 12 is flat is cross section.

As best shown in FIGS. 2 and 4, the faceted plate 16 has a generally circular configuration and presents a plurality of wedged elements, generally indicated at 30. The wedged elements 30 are interconnected by neck portions 32 extending from side walls 34 of each of the wedge element 30. Each wedge element 30 includes a generally conical shape and present an outer edge 36 and an inner edge 38. The outer edge 36 and the inner edge 38 include several gates 40. The gates 40 are used to hold diamonds 42. The faceted plate 16 has a generally flat cross section.

Referring back to FIGS. 2 and 4, the base plate 14 includes a peripheral wall, generally indicated at 60, presenting an upper rim 62 and a lower rim 63 spaced from the upper rim 62 and separated by supports 65. A plurality of tower members 64 of a generally square configuration extend from the upper rim 62. Each tower member 64 presents an opening 610 to hold the diamond 42 therein. The upper rim 62 further includes a first row of fingers or prongs 66 extending there from and a second row of fingers or prongs 68 also extending from the upper rim 62.

Alluding to the above, the base plate 14 is provided with the seats and the prongs 66 and 68 to hold the diamonds on the top and further includes negative space to affix and position the faceted plate 16 for easy assembly. The diamonds at the top are center of decoration. The base plate 14 also possesses split prongs for setting round diamond peripheral to the taper prong region. The prong emerges making a channel for the facet plate 16, and at the center where the diamonds can be placed. A hoop structure 69 is provided on the top base to entrench the bail 18 thereafter.

As best shown in FIG. 4, the upper rim 62 also includes a central wall 70 of a circular configuration defining a plurality of central fingers 72 located around openings 74. The upper rim 62 presents a bottom surface 76 that defined a seat 78 formed between the first row of the fingers 66 and the second row of the fingers 68. The seat 78 is used to engage and secure the faceted plate 16. The bottom surface 76 of the upper rim 62 also presents a step 80 to engage and secure the back plate 12.

The components of the device 10, i.e. the close-back plate 12, the base plate 14, the faceted plate 16, and the bail 18 are manufactured by lost wax investment casting technique. The faceted plate 16 is manufactured by lost wax investment casting method which matches with the negatives and voids for the protruded prong 66, 68, and 72 of the base plate 14. The faceted plate 16 undergoes metal cutting operation in a fan rotary machine with diamond tools.

The faceted plate 16 is then placed into the base plate 14 of the jewelry device 10, such that the faceted plate 16 submerges inside the base plate 14 and the prongs 66, 68, and 72 protrude from within. The tapper baguette diamonds are manually set in a particular pattern. The wide ends are at the outer end from the center-keeping the taper ends towards the center. There is an alternate arrangement of the tapper diamonds, making the below plate visible between the two tappers.

The assembly 10 is designed such that, the faceted plate 16 below the tapper along with the real tapper diamond creates an illusion. As a result of the illusion, the setting can be depicted as the jewelry is entirely studded with tapper diamond. The bail 18 can also be provided with prongs and counters for setting diamonds. The bail 18 is attached inside the hoop at the top of the base plate 14 and soldered. The close back, base-plate 14 and the bail 18 are soldered to complete the assembly 10.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A jewelry device holding a plurality of diamonds of various shapes and cuts, said jewelry device comprising:

a back plate including an inner circle and an outer circle, a plurality of radial connectors extending from said inner circle to said outer circle to form a plurality of windows between said inner circle and said outer circle, a plurality of radial elements extending from said outer circle;

a faceted plate having a generally circular configuration and flat cross section and presenting a plurality of wedged elements having side walls, said wedged elements being interconnected by neck portions extending from said side walls of each wedge element, each of said wedge elements including a generally conical shape and presenting an outer edge and an inner edge, said outer edge and said inner edge including several gates to hold the diamonds; and a base plate including a peripheral wall presenting an upper rim and a lower rim spaced from said upper rim and separated by supports, a plurality of tower members of a generally square configuration extending from said upper rim, wherein each of said tower members presents an opening to hold at least one of the diamonds therein, said upper rim further includes a first row of fingers extending from said upper rim and a second row of fingers extending from said upper rim, said upper rim further includes a central wall of a circular configuration surrounding a plurality of central fingers located around openings, a bottom surface of said upper rim defining a seat formed between said first row of said fingers and said second row of said fingers, wherein said seat is used to engage and secure said faceted plate and further includes a step to engage and secure said back plate.

2. The jewelry device as set forth in claim 1, wherein said base plate further includes negative space to affix and position said faceted plate for assembly.

3. The jewelry device as set forth in claim 1, wherein said base plate also includes split prongs for setting a round diamond.

4. The jewelry device as set forth in claim 1, wherein said back plate, said base plate, said faceted plate, and a bail are manufactured by lost wax investment casting technique, wherein said faceted plate matches with negatives and voids for said fingers protruding from said base plate.

5. The jewelry device as set forth in claim 1, wherein said faceted plate is then placed into said base plate such that said faceted plate submerges inside said base plate and said fingers extend thereinside.

6. The jewelry device as set forth in claim 1, wherein said base plate and a bail are soldered to complete assembly of said jewelry device.

7. A jewelry device holding a plurality of diamonds of various shapes and cuts, said jewelry device comprising:

a back plate including an inner circle and an outer circle, a plurality of radial connectors extending from said inner circle to said outer circle to form a plurality of windows between said inner circle and said outer circle;

a faceted plate having a generally circular configuration and flat cross section and presenting a plurality of wedged elements having side walls, said wedged elements being interconnected by neck portions extending from said side walls of each wedge element;

a base plate including a peripheral wall presenting an upper rim and a lower rim spaced from said upper rim and separated by supports, a plurality of tower members of a generally square configuration extending from said upper rim, wherein each of said tower members presents an opening to hold at least one of the plurality of the diamonds therein, said upper rim further includes a first row of fingers and a second row of fingers extending from said upper rim; and said faceted plate placed into said base plate such that said faceted plate submerges inside said base plate and said fingers protrude therefrom.

8. The jewelry device as set forth in claim 7, wherein a plurality of radial elements extend from said outer circle, said back plate including a flat cross section.

9. The jewelry device as set forth in claim 8, wherein each of said wedge elements presents an outer edge and an inner edge, said outer edge and said inner edge includes several gates to hold the diamonds.

10. The jewelry device as set forth in claim 9, wherein said base plate further includes negative space to affix and position said faceted plate for assembly.

11. The jewelry device as set forth in claim 10, wherein said base plate also includes prongs for setting round diamond.

12. The jewelry device as set forth in claim 7, wherein said back plate, said base plate, said faceted plate, and a bail are manufactured by lost wax investment casting technique, wherein said faceted plate matches with negatives and voids for said fingers protruding from said base plate.

13. The jewelry device as set forth in claim 12, wherein said base plate and a bail are soldered to complete assembly of said jewelry device.

* * * * *